US007425113B2

(12) United States Patent
Peterson et al.

(10) Patent No.: US 7,425,113 B2
(45) Date of Patent: Sep. 16, 2008

(54) PRESSURE AND CURRENT REDUCING IMPELLER

(75) Inventors: Todd Peterson, New Boston, MI (US); Ketan Adhvaryu, Sterling Heights, MI (US); Ramon Jaramillo, Sterling Heights, MI (US)

(73) Assignee: BorgWarner Inc., Auburn Hills, MI (US)

( * ) Notice: Subject to any disclaimer, the term of this patent is extended or adjusted under 35 U.S.C. 154(b) by 170 days.

(21) Appl. No.: 11/330,271

(22) Filed: Jan. 11, 2006

(65) Prior Publication Data

US 2007/0160455 A1 Jul. 12, 2007

(51) Int. Cl.
*F04D 5/00* (2006.01)

(52) U.S. Cl. ..... 415/53.1; 415/55.12; 415/55.2; 416/223 A; 416/228

(58) Field of Classification Search ..... 415/53.1, 415/55.1, 55.2; 416/223 A, 228
See application file for complete search history.

(56) References Cited

U.S. PATENT DOCUMENTS

| | | | | |
|---|---|---|---|---|
| 3,359,908 | A | 12/1967 | Toma | |
| 4,065,231 | A | 12/1977 | Litzenberg | |
| 4,204,802 | A * | 5/1980 | Schonwald et al. | 415/55.1 |
| 5,248,238 | A * | 9/1993 | Ishida et al. | 415/55.1 |
| 5,299,908 | A * | 4/1994 | Robbie | 415/55.1 |
| 5,395,210 | A | 3/1995 | Yamazaki et al. | |
| 5,407,318 | A | 4/1995 | Ito et al. | |
| 5,468,119 | A * | 11/1995 | Huebel et al. | 415/55.1 |
| 5,527,149 | A * | 6/1996 | Moss et al. | 415/55.1 |
| 5,762,469 | A | 6/1998 | Yu | |
| 6,056,506 | A | 5/2000 | Martin et al. | |
| 6,422,808 | B1 | 7/2002 | Moss et al. | |
| 6,454,520 | B1 | 9/2002 | Pickelman et al. | |
| 6,688,844 | B2 | 2/2004 | Yu | |
| 6,767,179 | B2 | 7/2004 | Kusagaya et al. | |
| 6,779,968 | B1 | 8/2004 | Rietschle et al. | |
| 7,048,494 | B2 * | 5/2006 | Iijima et al. | 415/55.1 |

FOREIGN PATENT DOCUMENTS

| | | |
|---|---|---|
| EP | 0 787 903 A2 | 8/1997 |
| EP | 1 452 738 A2 | 9/2004 |
| JP | 11218097 | 8/1999 |
| JP | 59211599 | 11/1999 |

* cited by examiner

*Primary Examiner*—Igor Kershteyn
(74) *Attorney, Agent, or Firm*—Warn Partners, P.C.

(57) ABSTRACT

A secondary air system providing a regeneration air pump wherein the vanes of the impeller are tapered from a point along the length of the vane to the root of the vane inside the air pump. The tapered vanes create desirable flow characteristics. The tapered vanes create a non-linear flow versus pressure characteristic. Thus, the tapered vanes in combination with a divider that extends circumferentially around the impeller and through the vanes causes the flow to increase. This non-linear characteristic created by the tapered vanes allows the secondary air system to maintain suitable operation at lower flow and pressure levels. Due to the tapered feature on the impeller, a dead head pressure is obtained at a lower pressure. The impeller arrangement also provides overall pump efficiency improvements.

35 Claims, 4 Drawing Sheets

PRESSURE AND CURRENT REDUCING IMPELLER

FIELD OF THE INVENTION

The present invention relates to a secondary air fan used in an exhaust system for a motor vehicle.

BACKGROUND OF THE INVENTION

When an engine goes through a cold start condition a secondary air flow fan can be used to inject air into the engine's exhaust system. The reason the air is injected into the exhaust system is so that oxygen is present in the exhaust system and causes excess hydrocarbons to be combusted. This also helps the catalytic converter to perform efficiently or achieve optimal temperature in a shorter amount of time.

An impeller fan can be used to create the air movement in the secondary air flow system. One phenomena that can occur with secondary air flow systems is what is referred to as "dead head" condition. A dead head condition is when the air flow or output channel from the impeller becomes blocked. In other words, due to impeller design the pump will reach relatively high pressures at dead head and prevent the downstream valve from closing.

Furthermore, as the pressure increases the electrical current drawn by the motor increases. This is an undesirable condition because it is a drag on the vehicle electrical system. Therefore, it is desirable to develop an impeller that would reduce the pressure at the dead head condition, and thus reduce the amount of current drawn by the impeller.

SUMMARY OF THE INVENTION

The present invention relates a secondary air system having a regeneration air pump wherein the vanes of the impeller are tapered from a point along the length of the vane to the base of the vane inside the air pump. The tapered vanes create desirable flow characteristics. The impeller arrangement provides an ideal flow characteristic that prevents high pressure from restricting the movement of the downstream valve. Thus, the tapered vanes create a non-linear flow versus pressure characteristic. This non-linear characteristic created by the tapered vanes allows the secondary air system to maintain suitable operation at lower flow and pressure levels. In addition, the tapered vanes of the impeller fan also function as a relief feature which creates a pressure loss as pressure builds in the system. Since the pressure in the secondary air system is reduced, a lower pressure is obtained at a dead head condition. The impeller arrangement also improves overall pump efficiency. All in all the invention described herein provides a secondary air system where the dead head pressure characteristics created in the secondary air system will be lower than the standard dead head pressure so that the valve can function properly, out of the range of undesirable back pressures and high currents.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
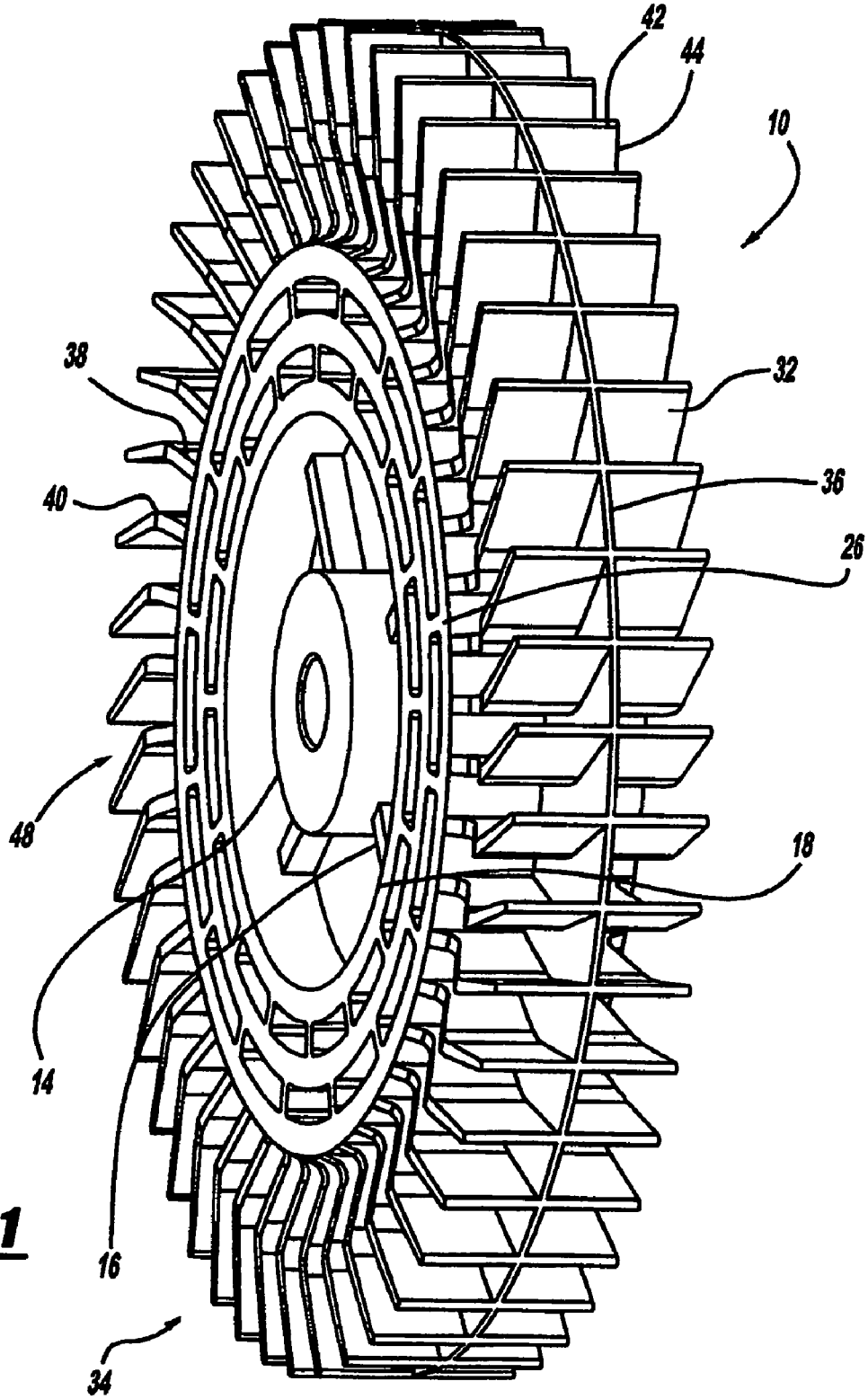
FIG. 1 is a perspective view of the impeller fan.

The following description of the preferred embodiment(s) is merely exemplary in nature and is in no way intended to limit the invention, its application, or uses.

Referring to FIGS. 1, 1*a*, 1*b*, and 2, an impeller fan is generally shown at 10 and the impeller 10 has a casing 12. The casing 12 has an inlet (not shown) and an outlet (not shown), in which the air flows in and out of the casing 12 respectfully. The center of the impeller 10 has an inner radial surface 14 that creates an axial bore where a shaft (not shown) can extend through the axial bore. The impeller 10 can then rotate. The impeller 10 has at least one radial support 16 that is spaced circumferentially around the inner radial surface 14, and extends radially to an outer radial surface 18. Therefore, the radial supports 16 connect the inner radial surface 14 with the outer radial surface 18.

Vanes 32 are spaced circumferentially around the impeller frame 26. The spacing of the vanes 32 around the outer radial surface 18 creates vane grooves 34 between each of the vanes 32. The vanes 32 have a base 35 that is connected to an impeller frame 26. The vanes 32 are angled at a point 40, such that neither an outer angled surface 42 nor the base 35 extend directly radially from the impeller frame 26. The vanes 32 have an inner angled surface 38 and the outer angled surface 42, which meet at the point 40, and the angle at which the vane 32 extends from the impeller frame 26 can be altered. Thus, the point 40 can be anywhere along the length of the vane 32.

Figure 1A:
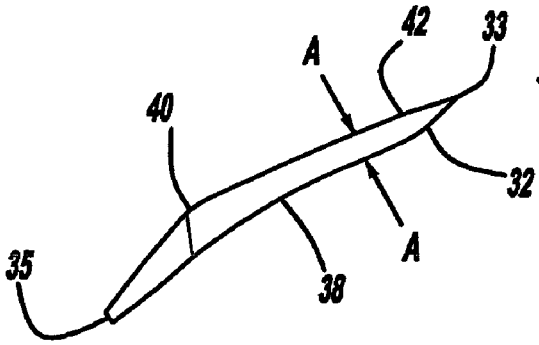
FIG. 1*a* is a top plan view of a vane with Line A-A depicting the thickness of the vane.

Furthermore, vanes 32 have a tapered thickness that is shown in FIG. 1*a*, which depicts a top view of a single vane 32 separated from the impeller 10. The thickness of the vane is shown at Line A-A in FIG. 1*a*. Thus, the tapered design at the vane 32 has a thickness that is greater at point 40 than the thickness of the vane 32 at the base 35 and at a vane tip 33. The thickness of the vane 32 can vary along its length or can be constant.

Figure 1B:
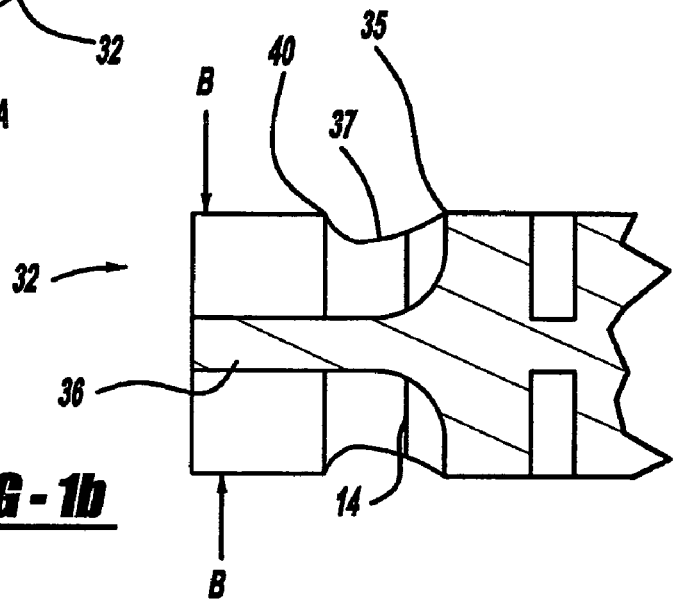
FIG. 1*b* is a side plan view of a single vane with Line B-B depicting the height of the vane.
Figure 2:
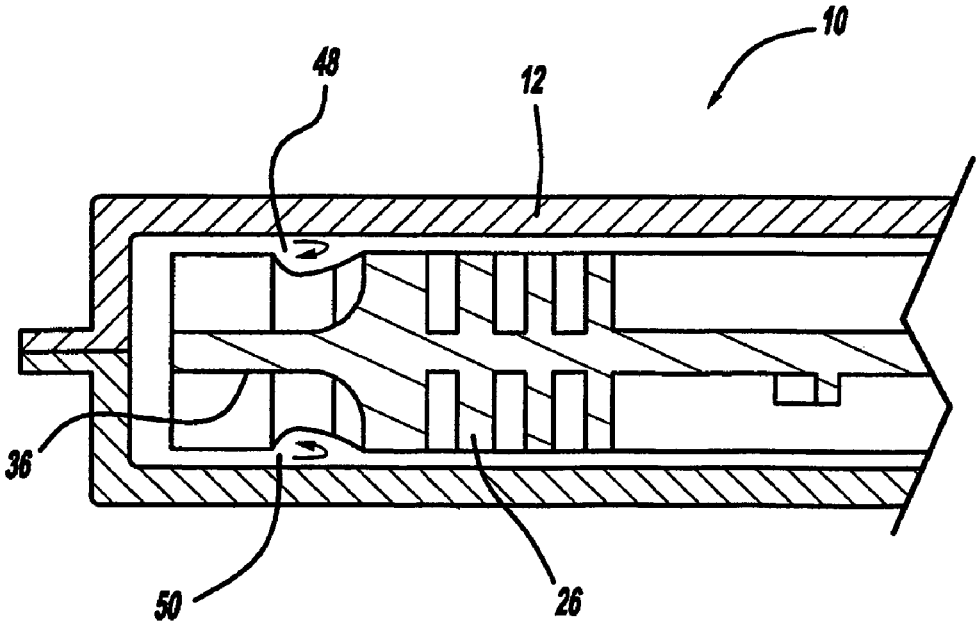
FIG. 2 is a cross-sectional view of the impeller fan.

FIGS. 1*b* and 2 depict a side view of an individual vane shown in FIGS. 1 and 1*a*. The height of the vane 32 is shown along Line B-B in FIG. 1*b*. Between the base 35 and the point 40 of each vane 32 there is a pressure relief feature 37. This pressure relief feature 37 is a curved recess or a change in the height in the vane 32 that will cause pressure relief as the vane moves within the casing 12. In particular the pressure relief feature 37 will relieve pressure between the inlet and outlet of the pump which reduces pressure at a deadhead condition. The pressure relief feature 37 does not necessarily have to have the curved shape shown, it can take virtually any shape. Additionally, the pressure relief feature 37 can be located anywhere along the length of the vane 32. The divider 36 can be located at any position along the height of the vane 32. Additionally the divider 36 can extend radially anywhere from the base 35 to the tip 33 of the vane 32.

The pressure relief feature 37 in the height of the vanes 32 changes the flow characteristics of impeller fan 10, so that a dead head pressure is reduced when compared to the dead head pressure created by a standard impeller fan. The vanes 32 in combination with the pressure relief feature 37 all contribute to pressure relief provided by impeller 10. If the divider 36 is used, it will create an upper flow area 48 and a lower flow area 50. The impeller fan 10 having vanes 32 in conjuncture with the divider 36 increases the flow, whereas an impeller fan that has no divider decreases the flow.

The pressure relief feature 37 of the vanes 32 and the divider 36 create a flow rate in the upper flow area 48 and a flow rate in the lower flow area 50. Both the upper flow area 48 and the lower flow area 50 have a pressure leakage between the inlet and outlet along the sealing area via the pressure relief feature 37. The leakage reduces the pressure in the upper flow area 48 and the lower flow area 50, which in turn reduces the dead head pressure. Thus, the reduction of the dead head pressure also reduces the amount of current drawn by the impeller 10.

Figure 4:
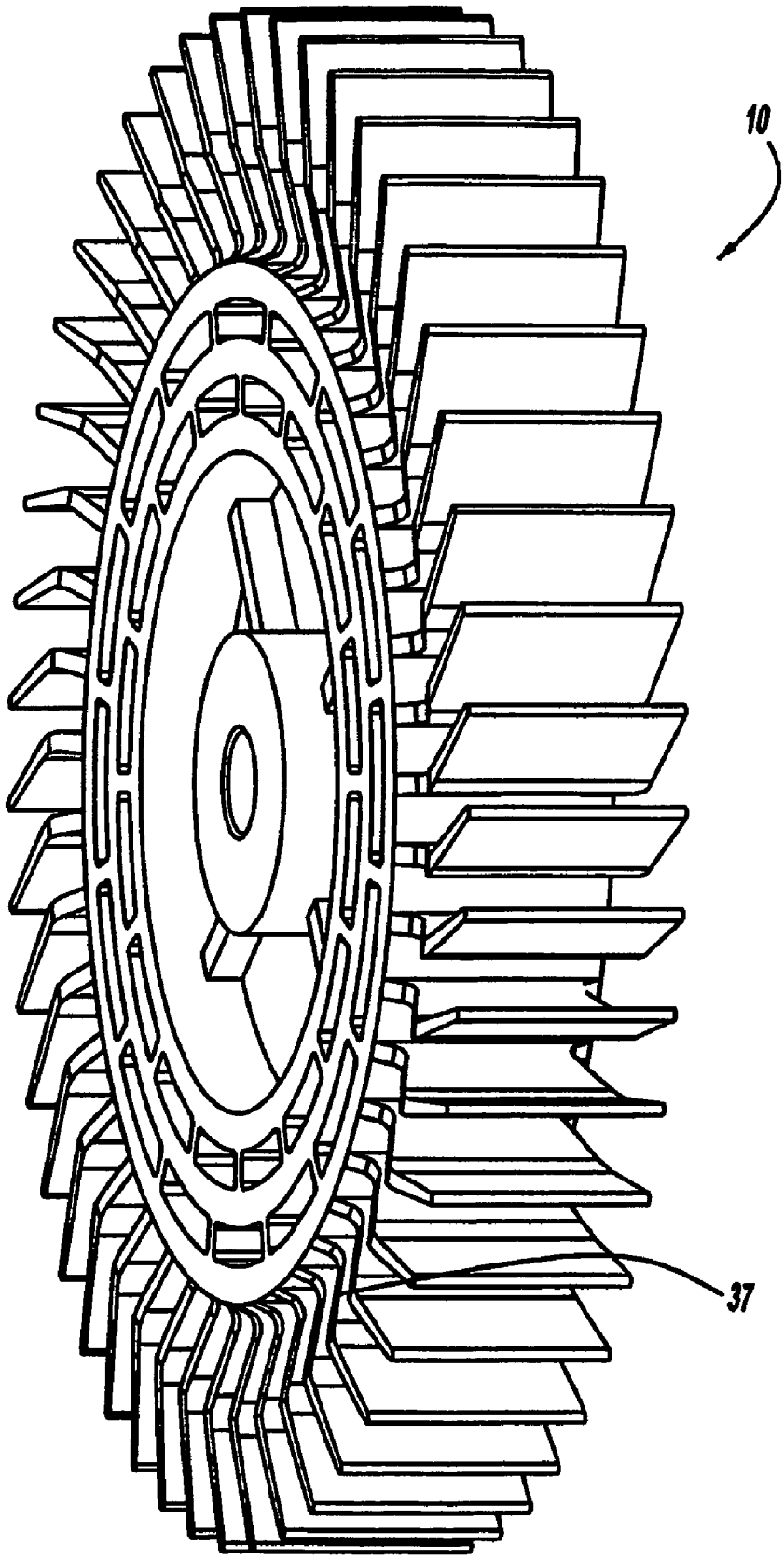
FIG. 4 is a perspective view of an impeller fan without a divider.

FIG. 4 depicts an embodiment where the impeller 10 has no divider extending between the vanes 32. However, the vanes 32 still have the pressure relief feature 37.

Figure 3:
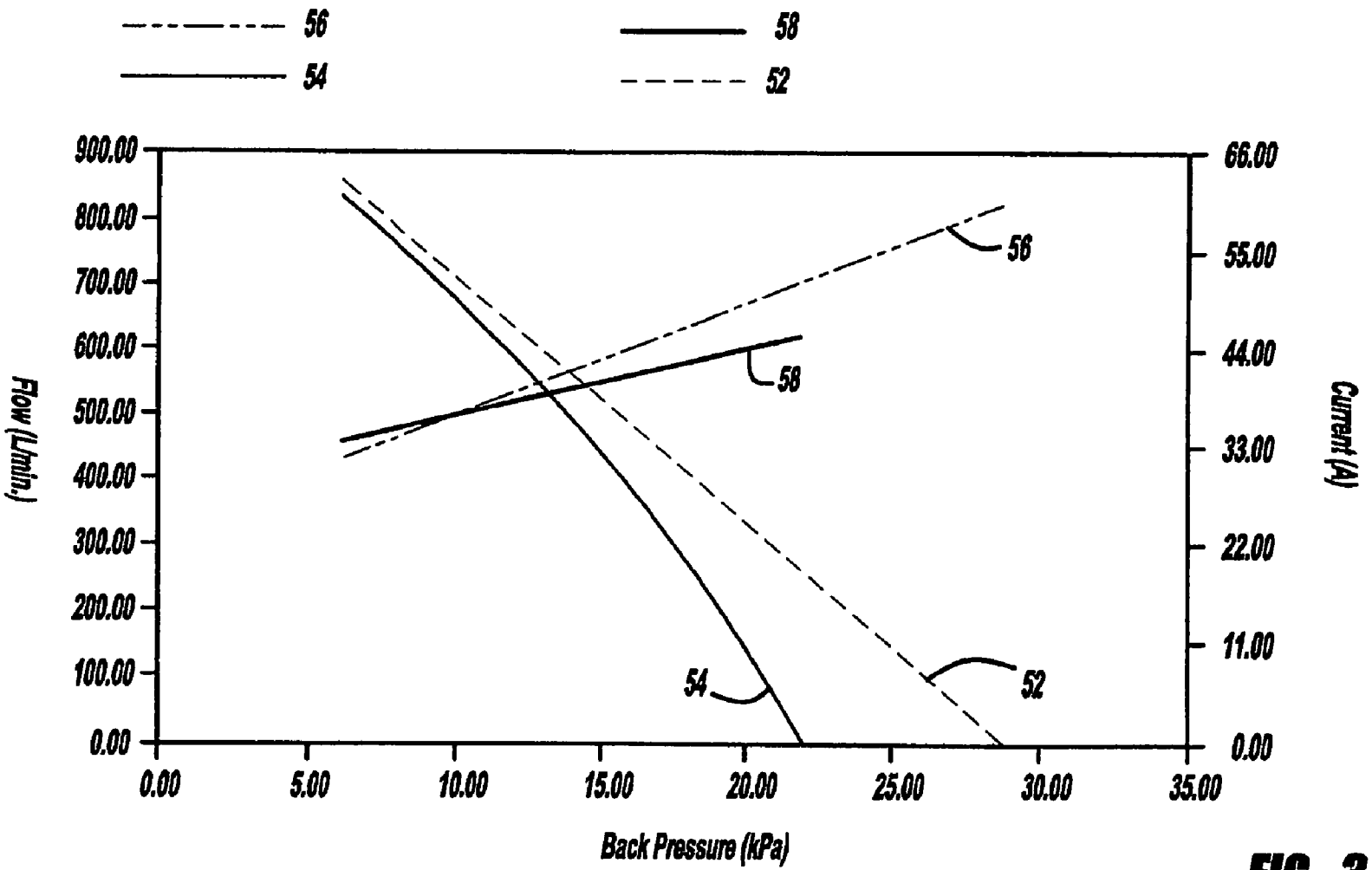
FIG. 3 is a line graph showing the flow, back pressure, and current characteristics of the secondary air pump.

Referring to FIG. 3, the flow, backpressure, and current characteristics are compared between a secondary air system using the impeller fan 10 and a standard impeller fan (one that does not have a vane design as the present invention). A line 52 depicts the flow and back pressure characteristics of the standard impeller. Line 56 shows that as the back pressure increases in the standard impeller fan the current continues to increase. Thus, the standard impeller fan causes the back pressure to increase to a final value that is too great for the secondary air system, and the back pressure is greater than 22 kPa when the flow is at 0.0 L/min. However, when the impeller fan 10 is used in the secondary air system the back pressure does not reach a maximum back pressure that is as high as that of a standard impeller fan, as shown by line 54. Therefore, when the flow is at 0.0 L/min the back pressure is approximately 22 kPa, which is lower than the standard dead head condition. Thus, the dead head pressure of the impeller fan 10 is approximately 20% less than a standard impeller. Likewise, the current draw of the impeller fan 10 is approximately 25% lower at the dead head condition, than a standard impeller fan at a dead head condition. Moreover, line 56 shows the amount of electrical current drawn by the standard impeller fan from the vehicle electrical system (not shown) as the back pressure increases. If a dead head condition is desired in the secondary air system the system may not function properly, if the back pressure is over 25 kPa these high back pressures result in high current drain in excess of 60 A. However, impeller fan 10 not only results in maximum back pressure less than 25 kPa but also does not draw as much current as the standard fan. Thus, the impeller 10 puts less strain on the vehicle electrical system.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An impeller for a pump comprising:

a casing having an inlet and an outlet;

said impeller contained in said casing;

said impeller having a plurality of vanes that extend radially outwards from an impeller frame;

at least one vane groove that is created by the space between said vanes when said vanes are spaced circumferentially around said impeller;

at least one divider extending between said vanes; and wherein each said vane has a pressure relief feature between a tip of said vane and of a base of said vane, and said pressure relief feature is a change in height of said plurality of vanes, creating an upper flow area, a lower flow area, or both an upper and lower flow area.

2. The impeller of claim 1 wherein said divider extends between said plurality of vanes, and said divider intersects the height of said vanes.

3. The impeller of claim 1, wherein said divider, and said vane, define said upper flow area.

4. The impeller of claim 1, wherein said divider, and said vane, define said lower flow area.

5. The impeller of claim 1, wherein said vane has a first angular radial extension between said impeller frame and a point of said vane.

6. The impeller of claim 5, wherein said first angular radial extension extends towards adjacent said vane.

7. The impeller of claim 1, wherein said vane has a second angular radial extension between a point of said vane and said casing.

8. The impeller of claim 7, wherein said second angular radial extension extends towards adjacent said vane.

9. The impeller of claim 1, wherein said tip is almost directly radially extended outward from said base.

10. The impeller of claim 1, wherein each said vane has a taper such that the thickness of a point along the length of said vane is greater than the thickness of said tip of said vane or said base of said vane.

11. An impeller for a pump comprising:

a casing having an inlet and an outlet;

said impeller rotatably contained in said casing;

said impeller having a plurality of vanes that extend radially outwards from an impeller frame;

at least one vane groove that is created by the space between said vanes when said vanes are spaced circumferentially around said impeller;

at least one divider in said at least one vane groove that extends between said vanes;

said vanes have a first angular radial extension between said impeller frame and a point, and a second angular radial extension between said point and said casing, wherein said point is anywhere along the length of said vane; and wherein each said vane has a pressure relief feature between a tip of said vane and a base of said vane, and said pressure relief feature is a change in height of said plurality of vanes, creating an upper flow area, a lower flow area, or both and upper and lower flow area.

12. The impeller of claim 11, wherein said divider, and said vane, define said upper flow area.

13. The impeller of claim 11, wherein said divider, and said vane, define said lower flow area.

14. The impeller of claim 11, wherein said first angular radial extension extends towards adjacent said vane.

15. The impeller of claim 11, wherein said second angular radial extension extends towards adjacent said vane.

16. The impeller of claim 11, wherein said divider intersects said vane along the height of said vane.

17. The impeller of claim 11 wherein each said vane has a taper such that the thickness of a point along the length of said vane is greater than the thickness of said tip of said vane or said base of said vane.

18. An impeller for a pump comprising:

a casing having an inlet and an outlet;

said impeller rotatably contained in said casing;

said impeller having a plurality of vanes that extend radially outwards from an impeller frame;

at least one vane groove that is created by the space between said vanes when said vanes are spaced circumferentially around said impeller;

at least one divider in at least one vane groove;

said vanes have a first angular radial extension between said impeller frame and a point wherein said first angular radial extension extends towards an adjacent vane, and a second angular radial extension between said point and said casing wherein said second angular radial extension extends towards an adjacent vane; wherein said point is anywhere along the length of said vane; and wherein each said vane has a pressure relief feature between a tip of said vane and a base of said vane, and said pressure relief feature is a change in height of said plurality of vanes, creating an upper flow area, a lower flow area, or both an upper and lower flow area.

19. The impeller of claim 18, wherein said divider intersects said vane along the height of said vane.

20. The impeller of claim 18, wherein said divider, and said vane, define said upper flow area.

21. The impeller of claim 18, wherein said divider, and said vane, define said lower flow area.

22. The impeller of claim 18 wherein each said vane has a taper such that the thickness of a point along the length of said vane is greater than the thickness of said tip of said vane or said base of said vane.

23. An impeller for a pump comprising:

a casing having an inlet and an outlet;

said impeller contained in said casing;

said impeller having a plurality of vanes that extend radially outwards from an impeller frame;

at least one vane groove that is created by the space between said vanes when said vanes are spaced circumferentially around said impeller; and wherein each said vane has pressure relief feature between of a tip of said vane and a base of said vane, and said pressure relief feature is a change in height of said plurality of vanes, creating an upper flow area, a lower flow area, or both an upper and lower flow area.

24. The impeller of claim 23, wherein said vane has a first angular radial extension between said impeller frame and a point on said vane.

25. The impeller of claim 24, wherein said first angular radial extension extends towards adjacent said vane.

26. The impeller of claim 24, wherein said vane has a second angular radial extension between a point of said vane and said casing.

27. The impeller of claim 26, wherein said second angular radial extension extends towards adjacent said vane.

28. The impeller of claim 23, wherein said tip is almost directly radially extended outward from said base.

29. The impeller of claim 23 wherein each said vane has a taper such that the thickness of a point along the length of said vane is greater than the thickness of said tip of said vane or said base of said vane.

30. An impeller for a pump comprising:

a casing having an inlet and an outlet;

impeller rotatably contained in said casing;

said impeller having a plurality of vanes that extend radially outwards from an impeller frame;

at least one vane groove that is created by the space between said vanes when said vanes are spaced circumferentially around said impeller;

said vanes have a first angular radial extension between said impeller frame and a point on said vanes, and a second angular radial extension between a point on said vanes and said casing, wherein said point is anywhere along the length of said vane; and wherein each said vane has a pressure relief feature between a tip of said vane and a base of said vane, and said pressure relief feature is a change in height of said plurality of vanes, creating an upper flow area, a lower flow area, or both an upper and lower flow area.

31. The impeller of claim 30, wherein said first angular radial extension extends towards adjacent said vane.

32. The impeller of claim 30, wherein said second angular radial extension extends towards adjacent said vane.

33. The impeller of claim 30 wherein each said vane has a taper such that the thickness of a point along the length of said vane is greater than the thickness of said tip or said base of said vane.

34. An impeller for a pump comprising:

a casing having an inlet and an outlet;

said impeller rotatably contained in said casing;

said impeller having a plurality of vanes that extend radially outwards from an impeller frame;

at least one vane groove that is created by the space between said vanes when said vanes are spaced circumferentially around said impeller;

said vanes have a first angular radial extension between said impeller frame and a point that extends towards an adjacent vane, and a second angular radial extension between said point and said casing that extends towards an adjacent vane; wherein said point is anywhere along the length of said vane; and wherein each said vane has a pressure relief feature between a tip of said vane and of a base of said vane, and said pressure relief feature is a change in height of said plurality of vanes, creating an upper flow area, a lower flow area, or both an upper and lower flow area.

35. The impeller of claim 34 wherein each said vane has a taper such that the thickness of a point along the length of said vane is greater than the thickness of said tip or said base of said vane.

* * * * *